US012304026B2

(12) United States Patent
Lovasz et al.

(10) Patent No.: US 12,304,026 B2
(45) Date of Patent: May 20, 2025

(54) SYSTEMS AND METHODS FOR DETECTING CONTACT DURING A PROCESS

(71) Applicant: GM GLOBAL TECHNOLOGY OPERATIONS LLC, Detroit, MI (US)

(72) Inventors: Joseph Gerard Lovasz, Ortonville, MI (US); Scott A Hucker, Ortonville, MI (US); David A Hann, Farmington Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 313 days.

(21) Appl. No.: 17/664,720

(22) Filed: May 24, 2022

(65) Prior Publication Data

US 2023/0381908 A1 Nov. 30, 2023

(51) Int. Cl.

| | |
|---|---|
| ***B24B 5/42*** | (2006.01) |
| ***B24B 49/04*** | (2006.01) |
| ***B24B 49/10*** | (2006.01) |

(52) U.S. Cl.

CPC ..... *B24B 5/42* (2013.01); *B24B 49/045* (2013.01); *B24B 49/10* (2013.01)

(58) Field of Classification Search

None

See application file for complete search history.

(56) References Cited

U.S. PATENT DOCUMENTS

| | | | | |
|---|---|---|---|---|
| 2009/0042483 | A1* | 2/2009 | Meki | B23Q 17/22 451/11 |
| 2015/0360343 | A1* | 12/2015 | Yavelberg | B24B 37/32 438/5 |
| 2018/0021908 | A1* | 1/2018 | Veittinger | B23Q 1/70 451/8 |
| 2020/0363293 | A1* | 11/2020 | Saum | G01N 27/87 |

FOREIGN PATENT DOCUMENTS

JP 2006181676 A * 7/2006

* cited by examiner

*Primary Examiner* — Thomas C Lee
*Assistant Examiner* — Anzuman Sharmin
(74) *Attorney, Agent, or Firm* — Lorenz & Kopf LLP

(57) ABSTRACT

Systems and methods are provided for detecting contact between a manufacturing apparatus and an article being worked upon by the manufacturing apparatus. Vehicles that include the article are also provided. The system includes the manufacturing apparatus configured to perform a process on the article, a signal transmitter configured to apply an input signal to the article with during the process such that the input signal is conducted through the article, a signal receiver configured to monitor a first component of the manufacturing apparatus to detect conduction of the input signal through the first component with during the process, and a signal processor configured to determine whether contact has occurred between the first component of the manufacturing apparatus and the article based on the detection of the input signal by the signal receiver.

16 Claims, 4 Drawing Sheets

SYSTEMS AND METHODS FOR DETECTING CONTACT DURING A PROCESS

INTRODUCTION

The technical field generally relates to a method of detecting unintended contact between components during a manufacturing process, and more particularly relates to a method of detecting unintended contact between a manufacturing apparatus and an article being worked upon by the manufacturing apparatus.

Internal combustion engines include at least one crankshaft that converts reciprocating linear movement of a piston into rotational movement about a crankshaft axis to provide torque to propel a vehicle, such as but not limited to a train, a boat, a plane, or an automobile, or to drive any other apparatus powered by the engine.

Various processes are performed to the crankshaft during production thereof, many of which are performed by automated manufacturing apparatuses. During these processes, components of the manufacturing apparatuses may become misaligned, for example, due to component wear, operational vibrations, and the like. In such situations, one or more of the components of the manufacturing apparatuses may unintentionally contact surfaces of the crankshaft and thereby cause damage to the crankshaft and/or the manufacturing apparatuses. Damage as seemingly minor as scratches on the crankshaft may have a significant effect. In particular, these scratches may each define a stress concentration (i.e., stress riser) which, under the significant torque typically applied to the crankshaft during operation thereof, may lead to cracking and ultimately catastrophic failure of the crankshaft. Unfortunately, the scratches caused by unintended contact with the components of the manufacturing apparatuses may be extremely difficult to detect without thorough analysis of the crankshaft.

Accordingly, it is desirable to provide a method of detecting unintended contact between components of a manufacturing apparatus and an article worked upon thereby, such as a crankshaft. Furthermore, other desirable features and characteristics of the present invention will become apparent from the subsequent detailed description and the appended claims, taken in conjunction with the accompanying drawings and the foregoing technical field and background.

SUMMARY

Systems and methods are provided for detecting contact between a manufacturing apparatus and an article being worked upon by the manufacturing apparatus. Vehicles that include the article are also provided.

A system includes the manufacturing apparatus configured to perform a process on the article, a signal transmitter configured to apply an input signal to the article with during the process such that the input signal is conducted through the article, a signal receiver configured to monitor a first component of the manufacturing apparatus to detect conduction of the input signal through the first component with during the process, and a signal processor configured to determine whether contact has occurred between the first component of the manufacturing apparatus and the article based on a detection of the input signal by the signal receiver.

In certain embodiments, the signal processor is configured to generate or initiate an alert in response to determining that contact has occurred between the first component of the manufacturing apparatus and the article.

In certain embodiments, the manufacturing apparatus is configured to automatically cease the process in response to the signal processor determining that contact has occurred between the first component of the manufacturing apparatus and the article.

In certain embodiments, the signal transmitter is configured to apply an electrical signal as the input signal and the signal receiver is configured to monitor for and detect the electrical signal.

In certain embodiments, the signal transmitter is configured to apply an ultrasonic signal as the input signal and the signal receiver is configured to monitor for and detect the ultrasonic signal.

In certain embodiments, a second component of the manufacturing apparatus is configured to contact the article during the process. The first component is formed of a first material and the second component is formed of a second material. The first material is more conductive than the second material.

In certain embodiments, the manufacturing apparatus is a crankshaft superfinishing station and the article is a crankshaft. The crankshaft superfinishing station may be configured to polish the crankshaft with a polish film of the crankshaft superfinishing station during the process and the first component may be a shoe configured to guide the polish film. The signal processor may be configured to determine whether contact has occurred between the shoe and a fillet of a main bearing journal or a pin bearing journal of the crankshaft.

A method includes performing a process on an article with a manufacturing apparatus, applying an input signal to the article with a signal transmitter during the process such that the input signal is conducted through the article, monitoring a first component of the manufacturing apparatus to detect conduction of the input signal therethrough with a signal receiver during the process, and determining whether contact has occurred between the first component of the manufacturing apparatus and the article with a signal processor based on a detection of the input signal by the signal receiver.

In certain embodiments, the method may include generating an alert in response to determining that contact has occurred between the first component of the manufacturing apparatus and the article.

In certain embodiments, the method may include automatically ceasing the process in response to the determining that contact has occurred between the first component of the manufacturing apparatus and the article.

In certain embodiments, the input signal is an electrical signal.

In certain embodiments, the input signal is an ultrasonic signal.

In certain embodiments, the process includes contacting the article with a second component of the manufacturing apparatus. The first component is formed of a first material and the second component is formed of a second material. The first material is more conductive than the second material.

In certain embodiments, the manufacturing apparatus is a crankshaft superfinishing station and the article is a crankshaft. The process may include polishing the crankshaft with a polish film of the crankshaft superfinishing station and the first component may be a shoe configured to guide the polish film. The method may include determining whether contact has occurred between the shoe and a fillet of a main bearing journal or a pin bearing journal of the crankshaft.

A vehicle includes the article described above.

In certain embodiments, the article is a crankshaft.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
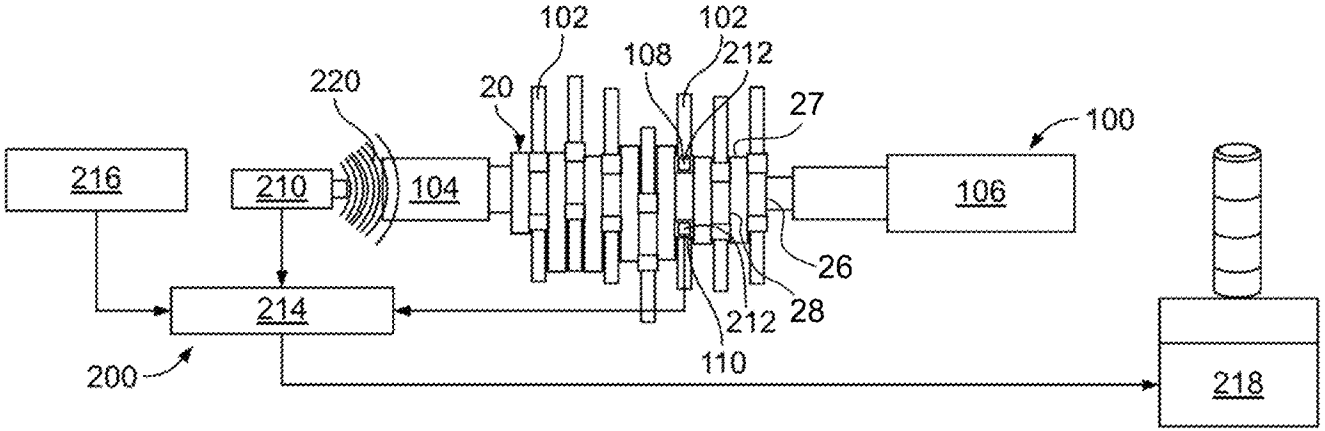
FIG. 1 is a schematic of a system for detecting unintended contact between a crankshaft superfinishing station and a crankshaft in accordance with an embodiment.

The following detailed description is merely exemplary in nature and is not intended to limit the application and uses. Furthermore, there is no intention to be bound by any expressed or implied theory presented in the preceding technical field, background, brief summary or the following detailed description.

As used herein, the word "exemplary" means "serving as an example, instance, or illustration". As used herein, "a," "an," or "the" means one or more unless otherwise specified. The term "or" can be conjunctive or disjunctive. Open terms such as "include," "including," "contain," "containing" and the like mean "comprising", but in certain embodiments may mean "consisting of". In certain embodiments, numbers in this description indicating amounts, ratios of materials, physical properties of materials, and/or use may be understood as being modified by the word "about". The term "about" as used in connection with a numerical value and the claims denotes an interval of accuracy, familiar and acceptable to a person skilled in the art. In general, such interval of accuracy is ±10%. All numbers in this description indicating amounts, ratios of materials, physical properties of materials, and/or use may be understood as modified by the word "about," except as otherwise explicitly indicated.

The figures are in simplified schematic form and are not to precise scale. Further, terms such as "upper", "lower", "above," "over," "below," "under," "upward," "downward," et cetera, are used descriptively of the figures, and do not represent limitations on the scope of the subject matter, as defined by the appended claims. Any numerical designations, such as "first" or "second" are illustrative only and are not intended to limit the scope of the subject matter in any way. It is noted that while embodiments may be described herein with respect to automotive applications, those skilled in the art will recognize their broader applicability.

Embodiments herein provide for detection of unintended contact between a manufacturing apparatus and an article being worked upon by the manufacturing apparatus. The embodiments allow for determinations that the manufacturing apparatus requires inspection, maintenance, and/or repair, and that the article being worked upon may be damaged and/or requires analysis. While specific embodiments are described herein including crankshaft superfinishing stations and crankshafts polished therewith, such descriptions are not limiting. Other manufacturing apparatuses and articles worked upon thereby are contemplated. In particular, various drilling apparatuses, milling apparatuses, grinding apparatuses, balancing apparatuses and various articles worked upon thereby are contemplated.

In certain examples, an input signal may be applied to the article as the article is worked upon by the manufacturing apparatus. Simultaneously, at least a first component of the manufacturing apparatus may be monitored to detect conduction of the input signal through the first component. If the first component unintentionally contacts the article, the input signal will be conducted through the article and into the first component of the manufacturing apparatus. Upon detection of the input signal in the first component of the manufacturing apparatus, a determination is made as to whether the first component contacted the article, and if so, an alert may be generated.

Figure 2:
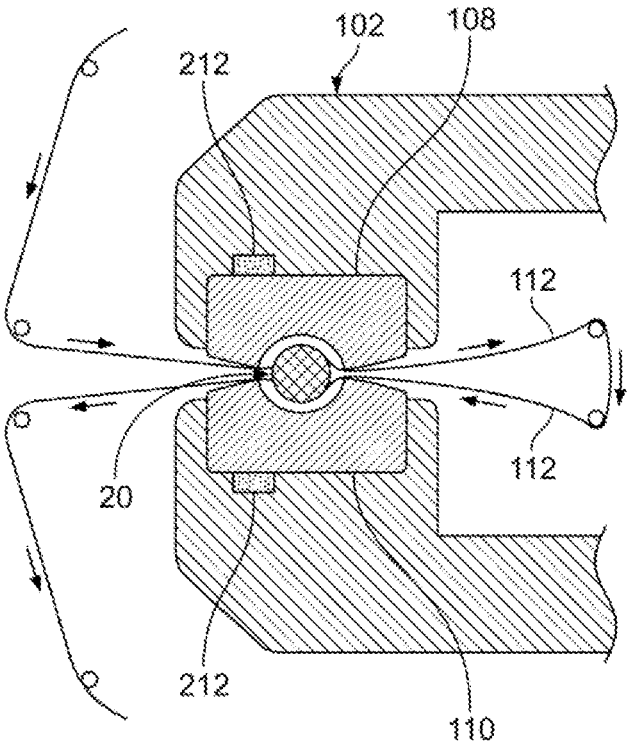
FIG. 2 is schematic of a polish arm assembly of the crankshaft superfinishing station of FIG. 1 and certain components of the system of FIG. 1 in accordance with an embodiment.

Referring now to FIGS. 1 and 2, an example of the system is presented, referred to hereinafter as the system 200, that is configured to detect unintended contact between components of a crankshaft superfinishing station 100 and a crankshaft 20 being worked upon thereby. The crankshaft 20 is of a type suitable for use with an internal combustion engine and the crankshaft superfinishing station 100 may be operated to polish surfaces of the crankshaft 20 during production thereof.

The crankshaft 20 includes a shaft extending along a crankshaft axis. The shaft includes main bearing journals 26, arms 27, and pin bearing journals 28 (i.e., crankpins). The main bearing journals 26 are disposed concentrically about the crankshaft axis. Each of the main bearing journals 26 is coupled to at least one of the arms 27. Each of the pin bearing journals 28 is laterally offset from the crankshaft axis and attached to the adjacent main bearing journals 26 on opposite sides of the pin bearing journals 28 by a pair of the arms 27.

The station 100 includes multiple polish arm assemblies 102 located between a headstock 104 and a footstock 106. To polish the crankshaft 20, ends of the crankshaft 20 may be secured the headstock 104 and the footstock 106, and each of the polish arm assemblies 102 may receive a portion of the crankshaft 20 between an upper shoe 108 and a lower shoe 110 thereof.

During operation of the crankshaft superfinishing station 100, the crankshaft 20 is rotated about the crankshaft axis and oscillated between the headstock 104 and the footstock 106. Polish films 112 coupled to the polish arm assemblies 102 travel along paths over portions of the crankshaft 20 such that the polish films 112 contact the crankshaft 20 to polish the surfaces thereof. Such surfaces of the crankshaft 20 may include but are not limited to exterior surfaces of the main bearing journals 26 and the pin bearing journals 28. To conform the polish films 112 to the surfaces of the crankshaft 20, the upper shoe 108 and the lower shoe 110 include curved, concave recesses corresponding to the curvature of the crankshaft 20 that are configured to guide the polish films 112 about the surfaces of the crankshaft 20. The upper shoe 108 and the lower shoe 110 may be articulated in directions toward the crankshaft 20 to maintain contact between the polish film 112 and the surfaces of the crankshaft 20.

Misalignment of the polish arm assemblies 102 may result in contact between the upper shoe 108 and/or the lower shoe 110 and fillets located along edges of the main bearing journals 26 and/or the pin bearing journals 28. Such contact may cause scratches, scores, or the like to the fillets. These scratches may each define a stress concentration (i.e., stress riser) which, under the significant torque typically applied to the crankshaft 20 during operation thereof, may lead to cracking and ultimately catastrophic failure of the crankshaft 20.

Therefore, the system 200 may be functionally coupled to the crankshaft superfinishing station 100 to detect unintended contact between components of the polish arm assemblies 102, such as the upper shoes 108 and/or the lower shoes 110, and surfaces of the crankshaft 20, such as the fillets of the main bearing journals 26 and/or the pin bearing journals 28. The system 200 includes a signal transmitter 210, one or more signal receivers 212, and a signal processor 214. The signal transmitter 210 is configured to apply an input signal 220 (represented by concentric arcs in FIG. 1) to the crankshaft 20 such that the input signal 220 is conducted through the crankshaft 20. In this example, the input signal 220 may be applied to the headstock 104 and conducted through the headstock 104 to the crankshaft 20. In some examples, the input signal 220 may be activated automatically, for example, by a programmable logic controller (PLC) 216. Automated activation of the input signal 220 may be in response to specific events, such as initiation of the crankshaft superfinishing station 100 or upon activation of an oscillation mode during which the crankshaft 20 is oscillated. In other examples, the input signal 220 may be activated manually. The input signal 220 may be applied to the crankshaft 20 continuously or periodically during operation of the crankshaft superfinishing station 100.

The signal receiver(s) 212 are configured to monitor the polish arm assemblies 102 or components thereof for the input signal 220 conducted therethrough. Upon detection of the input signal 220, the signal receiver(s) 212 are configured to communicate such detection to the signal processor 214. The signal processor 214 is configured to receive the communication from the signal receiver(s) 212 and analyze the communication to determine whether contact between certain components of the polish arm assemblies 102 and the crankshaft 20 are likely to have occurred (referred to hereinafter as an unintended contact event).

In some examples, the signal receiver(s) 212 may be configured to send a detection signal to the signal processor 214 and the signal processor 214 may be configured to identify the detection signal as an indication of an unintended contact event. Optionally, the signal processor 214 may compare the detection signal to a predetermined threshold prior to identifying the detection signal as an indication of an unintended contact event. For example, the threshold may relate to a minimum duration of the detected input signal 220, and the signal processor 214 may filter input signals 220 that were detected through the polish arm assemblies 102 or components thereof for a duration of less than the threshold.

Upon determination by the signal processor 214 that an unintended contact event has occurred, the signal processor 214 may generate an alert or communicate with another device to generate the alert. For example, in FIG. 1 the signal processor 214 is in communication with an operator console 218 that is configured to generate an alert in response to the signal processor 214 detecting an unintended contact event. The alert may be any communication suitable for calling attention of the unintended contact event to personnel or systems designated to response thereto. As nonlimiting examples, the alert may include an audible alert (e.g., an alarm) and/or a visual alert (e.g., a flashing light, an indicia displayed on a digital display screen). In some examples, the crankshaft superfinishing station 100 may be configured to deactivate and/or cease certain operations in response to the alert.

In response to the alert being generated, the designated personnel and/or systems may take appropriate action, such as deactivating the crankshaft superfinishing station 100, removing the crankshaft 20 from the crankshaft superfinishing station 100, analyzing the crankshaft 20 to identify any damage thereto, and/or inspecting the crankshaft superfinishing station 100 and performing any necessary maintenance, repairs, and/or calibration thereto to reduce the likelihood of subsequent unintended contact events.

Various types of input signals and sensing technologies may be used in the system 200 to detect the unintended contact event. In some examples, the input signal 220 is an electrical signal (e.g., current, voltage, etc.). For example, the signal transmitter 210 may generate an electrical signal, such as a low voltage, pulsed electrical signal, and apply the electrical signal as the input signal 220 to the headstock 104. Since the headstock 104 and the crankshaft 20 are formed of conductive materials (e.g., metallic materials), the electrical signal is conducted through the headstock 104 and into the crankshaft 20. During normal operation of the crankshaft superfinishing station 100, the electrical signal should not conduct to the polish arm assemblies 102 since the polish film 112 is formed of insulative materials. However, other components of the polish arm assemblies 102, such as the upper shoe 108 and the lower shoe 110, may be formed of conductive materials. Therefore, if one of these conductive components were to unintentionally contact the crankshaft 20, the electrical signal will conduct from the crankshaft 20, through the conductive component of the polish arm assembly 102, and be detected by the corresponding signal receiver 212. For examples in which the input signal 220 is an electrical signal (e.g., current, voltage, etc.), the signal receiver 212 may include, for example, a voltage sensor (e.g., capacitive, resistive, etc.) or a current sensor (e.g., Hall effect, Rogowski coils, etc.).

In other examples, the input signal 220 may be an ultrasonic signal (i.e., a sound wave having a frequency greater than 20 kHz). For example, the signal transmitter 210 may generate an ultrasonic signal and apply the ultrasonic signal as the input signal 220 to the headstock 104. Similar to the aforementioned electrical signal example, the ultrasonic signal is conducted through the conductive materials of the headstock 104 and into the crankshaft 20. Since the polish film 112 is formed of insulative materials, the ultrasonic signal should not conduct to the polish arm assemblies 102. However, if one of the conductive components of the polish arm assemblies 102 were to unintentionally contact the crankshaft 20, the ultrasonic signal will be conducted from the crankshaft 20, through the conductive component of the polish arm assembly 102, and be detected by the corresponding signal receiver 212.

Figure 3:
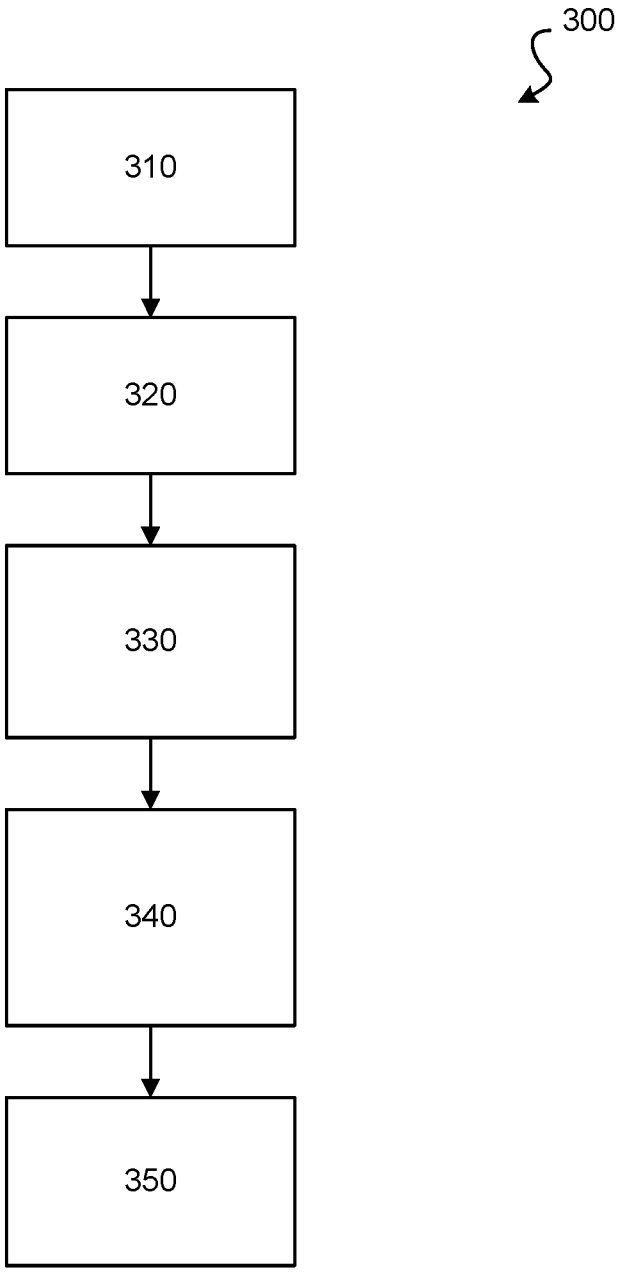
FIG. 3 is flow chart of a method of detecting unintended contact between a manufacturing apparatus and an article being worked upon by the manufacturing apparatus in accordance with an embodiment.

The system 200 provides for a method 300 of detecting unintended contact between a manufacturing apparatus and an article being worked upon thereby. As represented in step 310 of FIG. 3, the method 300 may include performing a process on an article with a manufacturing apparatus. In step 320, the method 300 includes applying an input signal to the article with a signal transmitter during the process. In step 330, the method 300 includes monitoring the manufacturing apparatus to detect conduction of the input signal therethrough with a signal receiver during the process. The method 300 may include continuing to monitor for conduction of the input signal through the manufacturing apparatus as long as the process being performed, and the input signal has not been detected with the signal receiver. In step 340, upon detection of conduction of the input signal through the manufacturing apparatus, the method 300 includes determining whether an unintended contact between the manufacturing apparatus and the article being worked upon thereby has occurred based on the detection of the input signal. If a determination is made that no unintended contact has occurred, the method 300 may include continuing to monitor for conduction of the input signal through the manufacturing apparatus. In step 350, the method 300 includes generating an alarm in response to determination that unintended contact has occurred.

In some examples, the process being performed may include intentional physical contact between a first component (e.g., the polish film 112) of the manufacturing apparatus and the article, and the method 300 may include analyzing the input signal detected by the signal receiver to determine if physical contact occurred between a second component (e.g., the upper shoe 108 or the lower shoe 110) of the manufacturing apparatus and the article. In such examples, the first component may be formed of a first material (e.g., an insulative material) and the second component may be formed of a second material (e.g., a metallic material), wherein the first material is less conductive than the second material.

Figure 4:
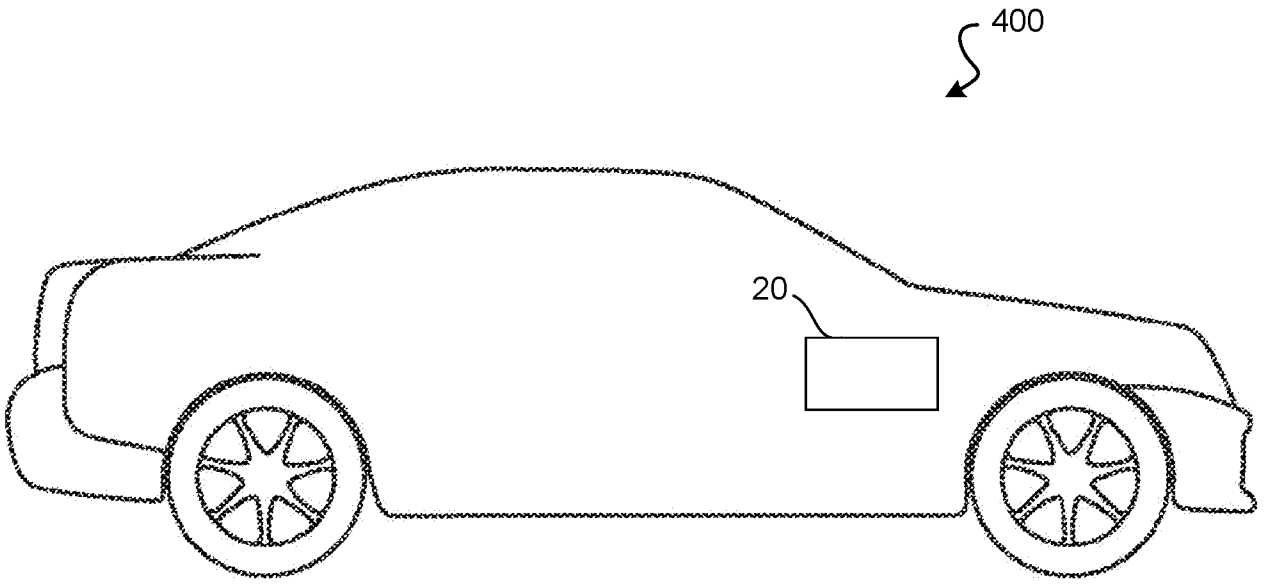
FIG. 4 is a vehicle that includes a crankshaft in accordance with an embodiment.

In some examples, the article may be a component configured to be installed in a vehicle, such as an automobile, a train, a boat, or a plane. For example, the crankshaft 20 may be secured to an engine block of a combustion engine installed in a vehicle at the main bearing journals 26 via bearings disposed about and supported by the main bearing journals 26, between the crankshaft 20 and the engine block. Each of the pin bearing journals 28 supports a bearing thereabout, and provides the attachment point to which a connecting rod attaches a piston to the crankshaft 20. Reciprocating pistons may be attached to the pin bearing journals 28 via connecting rods. Force applied from the pistons to the crankshaft 20 through the offset connection therebetween generates torque in the crankshaft 20, which rotates the crankshaft 20 about the crankshaft axis. FIG. 4 presents a nonlimiting example of a vehicle 400 that includes the crankshaft 20 installed therein.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A system, comprising:

a manufacturing apparatus configured to perform a process on an article, wherein the manufacturing apparatus includes a first component and a second component, wherein the first component is configured to contact the article during the process and the second component is configured to not contact the article during the process, wherein the first component and the second component are in contact with each other during the process;

a signal transmitter configured to generate and apply an input signal to the article during the process such that the input signal is conducted through the article, wherein the first component is formed of a first material that is insulative to the input signal and the second component is formed of a second material that is conductive to the input signal;

a signal receiver configured to monitor at least the second component of the manufacturing apparatus to detect conduction of the input signal through the second component during the process resulting from an unintended contact between the second component and the article, wherein the signal receiver is configured to continue monitoring for the input signal as long as the process is being performed and the input signal has not been detected; and a signal processor configured to determine whether contact has occurred between the second component of the manufacturing apparatus and the article during the process in response to detection of the input signal by the signal receiver.

2. The system of claim 1, wherein the signal processor is configured to generate or initiate an alert in response to determining that contact has occurred between the second component of the manufacturing apparatus and the article.

3. The system of claim 1, wherein the manufacturing apparatus is configured to automatically cease the process in response to the signal processor determining that contact has occurred between the second component of the manufacturing apparatus and the article.

4. The system of claim 1, wherein the signal transmitter is configured to generate and apply an electrical signal as the input signal and the signal receiver is configured to monitor for and detect the electrical signal.

5. The system of claim 1, wherein the signal transmitter is configured to generate and apply an ultrasonic signal as the input signal and the signal receiver is configured to monitor for and detect the ultrasonic signal.

6. The system of claim 1, wherein the manufacturing apparatus is a crankshaft superfinishing station and the article is a crankshaft.

7. The system of claim 6, wherein the crankshaft superfinishing station is configured to polish the crankshaft with a polish film of the crankshaft superfinishing station during the process, wherein the first component is the polish film and the second component is a shoe configured to guide the polish film, wherein the input signal is not conducted from the first component to the second component during the process.

8. The system of claim 7, wherein the signal processor is configured to determine whether contact has occurred between the shoe and a fillet of a main bearing journal or a pin bearing journal of the crankshaft.

9. A method, comprising:

performing a process on an article with a manufacturing apparatus, wherein the process includes intentionally contacting the article with a first component of the manufacturing apparatus and not intentionally contacting the article with a second component of the manufacturing apparatus that is in contact with the first component during the process;

generating and applying an input signal to the article with a signal transmitter during the process such that the input signal is conducted through the article, wherein the first component is formed of a first material that is insulative to the input signal and the second component is formed of a second material that is conductive to the input signal;

monitoring at least the second component of the manufacturing apparatus to detect conduction of the input signal therethrough with a signal receiver during the process resulting from an unintentional contact between the second component and the article, and continuing to monitor for the input signal with the signal receiver as long as the process is being performed and the input signal has not been detected; and determining whether the unintentional contact has occurred between the second component of the manufacturing apparatus and the article during the process with a signal processor based on a detection of the input signal by the signal receiver.

10. The method of claim 9, further comprising generating an alert in response to determining that contact has occurred between the second component of the manufacturing apparatus and the article.

11. The method of claim 9, further comprising automatically ceasing the process in response to the determining that contact has occurred between the second component of the manufacturing apparatus and the article.

12. The method of claim 9, wherein the input signal is an electrical signal.

13. The method of claim 9, wherein the input signal is an ultrasonic signal.

14. The method of claim 9, wherein the manufacturing apparatus is a crankshaft superfinishing station and the article is a crankshaft.

15. The method of claim 14, wherein the process includes polishing the crankshaft with a polish film of the crankshaft superfinishing station, wherein the first component is the polish film and the second component is a shoe configured to guide the polish film, wherein the input signal is not conducted from the first component to the second component during the process.

16. The method of claim 15, further comprising determining whether contact has occurred between the shoe and a fillet of a main bearing journal or a pin bearing journal of the crankshaft.

* * * * *